US009077078B2

(12) United States Patent
Rodriguez De Luis et al.

(10) Patent No.: US 9,077,078 B2
(45) Date of Patent: Jul. 7, 2015

(54) RECONFIGURABLE MONOPOLE ANTENNA FOR WIRELESS COMMUNICATIONS

(71) Applicant: Microsoft Corporation, Redmond, WA (US)

(72) Inventors: Javier Rodriguez De Luis, Redmond, WA (US); Alireza Mahanfar, Bellevue, WA (US); Benjamin Shewan, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 239 days.

(21) Appl. No.: 13/707,439

(22) Filed: Dec. 6, 2012

(65) Prior Publication Data

US 2014/0159982 A1 Jun. 12, 2014

(51) Int. Cl.

| | |
|---|---|
| ***H01Q 1/24*** | (2006.01) |
| ***H01Q 1/50*** | (2006.01) |
| ***H01Q 9/42*** | (2006.01) |
| ***H01Q 5/10*** | (2015.01) |
| ***H01Q 5/35*** | (2015.01) |
| ***H01Q 5/378*** | (2015.01) |

(52) U.S. Cl.
CPC . *H01Q 1/50* (2013.01); *H01Q 9/42* (2013.01); *H01Q 5/10* (2015.01); *H01Q 5/35* (2015.01); *H01Q 5/378* (2015.01)

(58) Field of Classification Search
CPC ..... H01Q 5/10; H01Q 1/50; H01Q 5/35; H01Q 9/42; H01Q 5/378
USPC ..... 343/702, 700 MS, 846
See application file for complete search history.

(56) References Cited

U.S. PATENT DOCUMENTS

| | | | | |
|---|---|---|---|---|
| 6,140,966 | A | 10/2000 | Pankinaho | |
| 7,050,004 | B2 | 5/2006 | Shafai et al. | |
| 7,330,152 | B2 | 2/2008 | Zhang et al. | |
| 7,564,411 | B2 | 7/2009 | Piisila et al. | |
| 8,248,312 | B2 | 8/2012 | Guan et al. | |
| 2005/0099347 | A1* | 5/2005 | Yamaki | 343/749 |
| 2005/0243000 | A1* | 11/2005 | Hwang et al. | 343/702 |
| 2007/0146212 | A1 | 6/2007 | Ozden et al. | |
| 2010/0231461 | A1 | 9/2010 | Tran | |

(Continued)

FOREIGN PATENT DOCUMENTS

| | | | |
|---|---|---|---|
| JP | 10190345 | * | 7/1998 |
| WO | WO 2009/026304 | | 2/2009 |
| WO | WO 2009/027579 | | 3/2009 |

OTHER PUBLICATIONS

Behdad, et al., "Dual-Band Reconfigurable Antenna with a Very Wide Tunability Range", *In Proceedings of the IEEE transactions on Antennas and Propagation*, vol. 54, No. 2, Feb. 2006, 8 pages.

(Continued)

*Primary Examiner* — Hoanganh Le
(74) *Attorney, Agent, or Firm* — Ladislav Kusnyer; Judy Yee; Micky Minhas

(57) ABSTRACT

A reconfigurable monopole antenna is described which includes a radiator element coupled to a feed point through at least two different current paths. The current paths are of different lengths to accommodate different frequency bands. To change the current paths, a feed-point switch is positioned at the antenna feed point for selectively supplying current along either a first current path or a second current path. The current paths share a majority of the radiator element so that separate radiator elements need not be used.

15 Claims, 6 Drawing Sheets

(56) References Cited

U.S. PATENT DOCUMENTS

| | | | |
|---|---|---|---|
| 2011/0133994 | A1 | 6/2011 | Korva |
| 2011/0241949 | A1 | 10/2011 | Nickel et al. |
| 2012/0001808 | A1 | 1/2012 | Nekozuka |
| 2012/0009983 | A1 | 1/2012 | Mow et al. |
| 2012/0229347 | A1 | 9/2012 | Jin et al. |
| 2013/0157598 | A1 | 6/2013 | Rozenblit et al. |
| 2014/0038662 | A1 | 2/2014 | Alberth et al. |

OTHER PUBLICATIONS

Ebrahimi, Elham, "Wideband and Reconfigurable Antennas for Emerging Wireless Networks", *In a Thesis Submitted to the University of Birmingham for the Degree of Doctor of Philosophy* (*PhD*), Sep. 2011, 266 pages.

Liang, et al., "Multi-Band Frequency Reconfigurable Planar Inverted-F Antenna Designs", *In Proceedings of XXIX General Assembly of the International Union of Radio Scientifique Internationale*, Aug. 14, 2008, 4 pages.

Liu, et al., "Dual-Frequency Planar Inverted-F Antenna", *In Proceedings of the IEEE transactions on Antennas and Propagation*, vol. 45, No. 10, Oct. 1997, 8 pages.

International Search Report and Written Opinion from the European Patent office for corresponding Application No. PCT/US2013/073734, mailed Mar. 19, 2014, 11 pages).

International Search Report and Written Opinion from the European Patent office for corresponding Application No. PCT/US2013/073731, mailed Mar. 27, 2014 (9 pages).

Cettner, et al., "Multifunctional Reconfigurable MEMS Integrated Antennas for Adaptive MIMO Systems", *In Proceedings of IEEE Communications Magazine*, Dec., 2004, 9 pages.

Huff, et al., "Integration of Packaged RF MEMS Switches With Radiation Pattern Reconfigurable Square Spiral Microstrip Antennas," *In Proceedings of IEEE Transactions on Antennas and Propagation*, vol. 54, Issue 2, Feb., 2006, 6 pages.

Kivekas, et al., "Frequency-Tunable Internal Antenna for Mobile Phones," *In Proceedings of 12th International Symposium on Antennas*, Nov. 14, 2002, 4 pages.

Komulainen, et al., "A Frequency Tuning Method for a Planar Inverted-F Antenna", *In Proceedings of IEEE Transactions on Antennas and Propagation*, vol. 56, Issue 4, Apr., 2008, 7 pages.

Mak, et al., "Reconfigurable Multiband Antenna Designs for Wireless Communication Devices," *In Proceedings of IEEE Transactions on Antennas and Propagation*, vol. 55, Issue 7, Jul., 2007, 10 pages.

Sheta, et al., "Compact Dual-band Tunable Microstrip Antenna for GSM/DCS1800 Applications", *In Proceedings of IET Microwaves, Antennas & Propagation*, vol. 2, Issue 3, Oct. 9, 2006, 7 pages.

Wang, et al., "A Slot Antenna Module for Switchable Radiation Patterns," *In Proceedings of IEEE Antennas and Wireless Propagation Letters*, vol. 4, Jun. 2005, 3 pages.

Yang, et al., "Patch Antennas with Switchable Slots (PASS) in Wireless Communications:Concepts, Designs, and Applications", in Proceedings of IEEE Antennas and Propagation Magazine, vol. 47, Issue 2, Apr. 2005, 17 pages.

Yoon, et al., "Frequency Reconfigurable PIFA for Cell-Phone Application", Retrieved on: Nov. 14, 2012, Available at: http://ap-s.ei.tuat.ac.jp/isapx/2011/pdf/[FrP2-33]%20A15_1005.pdf.

* cited by examiner

RECONFIGURABLE MONOPOLE ANTENNA FOR WIRELESS COMMUNICATIONS

BACKGROUND

In mobile devices, the number of supported frequency bands continues to increase with increasing demands for new features and higher data throughput. Some examples of new features include multiple voice/data communication links—GSM, CDMA, WCDMA, LTE, EVDO—each in multiple frequency bands, short range communication links (Bluetooth, UWB), broadcast media reception (MediaFLO, DVB-H), high speed internet access (UMB, HSPA, 802.11, EVDO), and position location technologies (GPS, Galileo). Supporting multiple frequency bands results in increased complexity and design challenges. Often, tradeoffs are made to support multiple frequency bands, at the cost of performance.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A multiband monopole antenna is disclosed that can be dynamically and programmatically reconfigured to accommodate different frequency bands. In one embodiment, a radiator element is coupled to a feed point through a feed-point switch. The switch can direct current between the feed point and the radiator element using at least two different current paths. The current paths can be of different lengths so as to be optimized for the different frequency bands. Each current path can share a majority of a radiator element so as to save space. By switching the feed-point switch to select one of the current paths, the antenna can be configured. Selection can be controlled from a modem or even user input.

In another embodiment, a parasitic radiator can be coupled to ground through a ground switch. Using the feed-point switch and the ground switch multiple modes of operation can be implemented using a single antenna structure.

Overall performance can, therefore, be improved with minimal additional components.

The foregoing and other objects, features, and advantages of the invention will become more apparent from the following detailed description, which proceeds with reference to the accompanying figures.

DETAILED DESCRIPTION

A reconfigurable monopole antenna is described which includes a radiator element coupled to a feed point through at least two different current paths. The current paths are of different lengths to accommodate different frequency bands. To change the current paths, a feed-point switch is positioned at the antenna feed point for selectively supplying current along either a first current path or a second current path. The current paths share a majority of the radiator element so that separate radiator elements need not be used.

By supplying an antenna that is designed to tune or switch between different bands, there is no need to supply separate antennas. As a result, the antenna size is reduced given that the same resonator structure acts as radiator element for different frequencies. The space that is saved can be used for other purposes, such as a battery, circuitry or device size reduction. Additionally, antenna performance improves (e.g., higher QoS, lower dropped calls, higher battery life) due to the absence of tradeoffs made in prior multiple band configurations. Additionally, the antenna can be positioned in more aggressive volumes, such as on top of a PCB ground plane, which can have benefits from hand/head detuning effect and the regulated absorption of energy to the human tissue (specific absorption ratio, SAR). Placing the switches close to the feed point (where no high electric fields are present) can minimize the generation of fundamental harmonics, which could assist in passing regulatory testing.

In specific embodiments, an antenna is disclosed that uses several switchable elements within a radiating structure itself. One single-pole-double-throw (SPDT) switch can be utilized to cover two different groups of frequency bands located in a lower frequency spectrum of LTE (e.g., 800 MHz). For example, a short path can allow operation at high frequency bands while a longer path can allow operation at the lower frequencies. An additional single-pole-single-throw (SPST) can be used to provide antenna operation in the group of bands allocated at the high frequency spectrum (e.g., 2 GHz). Thus, the antenna allows each band or groups of bands to be adjusted independently through the use of switches located at the antenna feed point or near the feed point (e.g., within $\lambda/10$). The switches can prevent or allow currents on demand depending on the desired frequency of operation.

Figure 1:
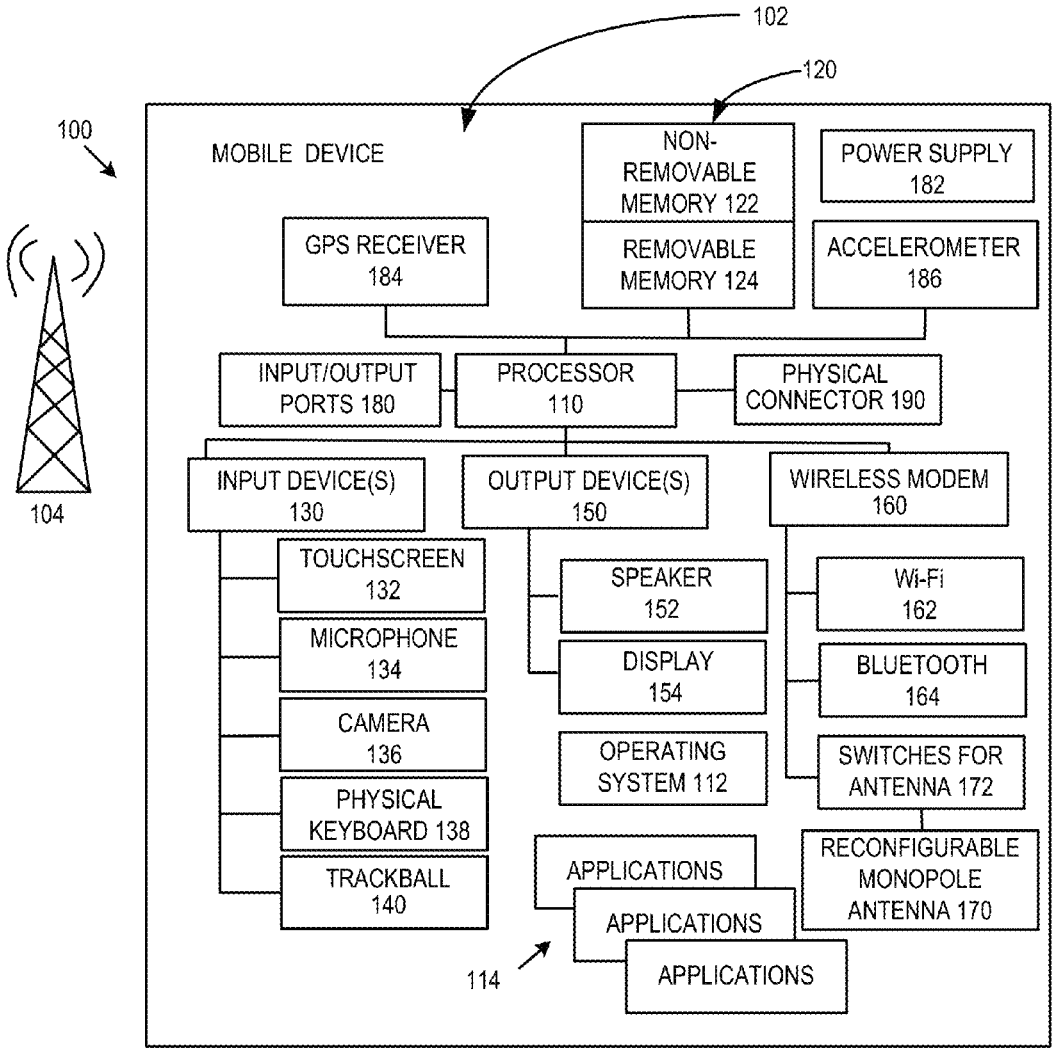
FIG. 1 is an embodiment of a mobile device incorporating a reconfigurable monopole antenna.

FIG. 1 is a system diagram depicting an exemplary mobile device 100 including a variety of optional hardware and software components, shown generally at 102. Any components 102 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 104, such as a cellular or satellite network.

The illustrated mobile device 100 can include a controller or processor 110 (e.g., signal processor, microprocessor, ASIC, or other control and processing logic circuitry) for performing such tasks as signal coding, data processing, input/output processing, power control, and/or other functions. An operating system 112 can control the allocation and usage of the components 102 and support for one or more application programs 114. The application programs can include common mobile computing applications (e.g., email applications, calendars, contact managers, web browsers, messaging applications), or any other computing application.

The illustrated mobile device 100 can include memory 120. Memory 120 can include non-removable memory 122 and/or removable memory 124. The non-removable memory 122 can include RAM, ROM, flash memory, a hard disk, or other well-known memory storage technologies. The removable memory 124 can include flash memory or a Subscriber Identity Module (SIM) card, which is well known in GSM communication systems, or other well-known memory storage technologies, such as "smart cards." The memory 120 can be used for storing data and/or code for running the operating system 112 and the applications 114. Example data can include web pages, text, images, sound files, video data, or other data sets to be sent to and/or received from one or more network servers or other devices via one or more wired or wireless networks. The memory 120 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 100 can support one or more input devices 130, such as a touchscreen 132, microphone 134, camera 136, physical keyboard 138 and/or trackball 140 and one or more output devices 150, such as a speaker 152 and a display 154. Other possible output devices (not shown) can include piezoelectric or other haptic output devices. Some devices can serve more than one input/output function. For example, touchscreen 132 and display 154 can be combined in a single input/output device. The input devices 130 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 112 or applications 114 can comprise speech-recognition software as part of a voice user interface that allows a user to operate the device 100 via voice commands. Further, the device 100 can comprise input devices and software that allows for user interaction via a user's spatial gestures, such as detecting and interpreting gestures to provide input to a gaming application.

A wireless modem 160 can be coupled to a reconfigurable monopole antenna 170 and can support two-way communications between the processor 110 and external devices, as is well understood in the art. The modem 160 is shown generically and can include a cellular modem for communicating with the mobile communication network 104 and/or other radio-based modems (e.g., Bluetooth 164 or Wi-Fi 162). The wireless modem 160 is typically configured for communication with one or more cellular networks, such as a GSM network for data and voice communications within a single cellular network, between cellular networks, or between the mobile device and a public switched telephone network (PSTN). The one or more modems can communicate (transmit and receive) with the antenna 170 through one or more switches 172 that are used to configure the antenna for multiple frequency bands of operation, as further described below. The switches 172 can be controlled automatically by the modems based on an optimal frequency band to be used, or user input can be received through one of the input devices 130 to select the desired frequency band. In any event, the antenna 170 is selectably and programmatically configurable.

The mobile device can further include at least one input/output port 180, a power supply 182, a satellite navigation system receiver 184, such as a Global Positioning System (GPS) receiver, an accelerometer 186, and/or a physical connector 190, which can be a USB port, IEEE 1394 (FireWire) port, and/or RS-232 port. The illustrated components 102 are not required or all-inclusive, as any components can be deleted and other components can be added.

Figure 2:
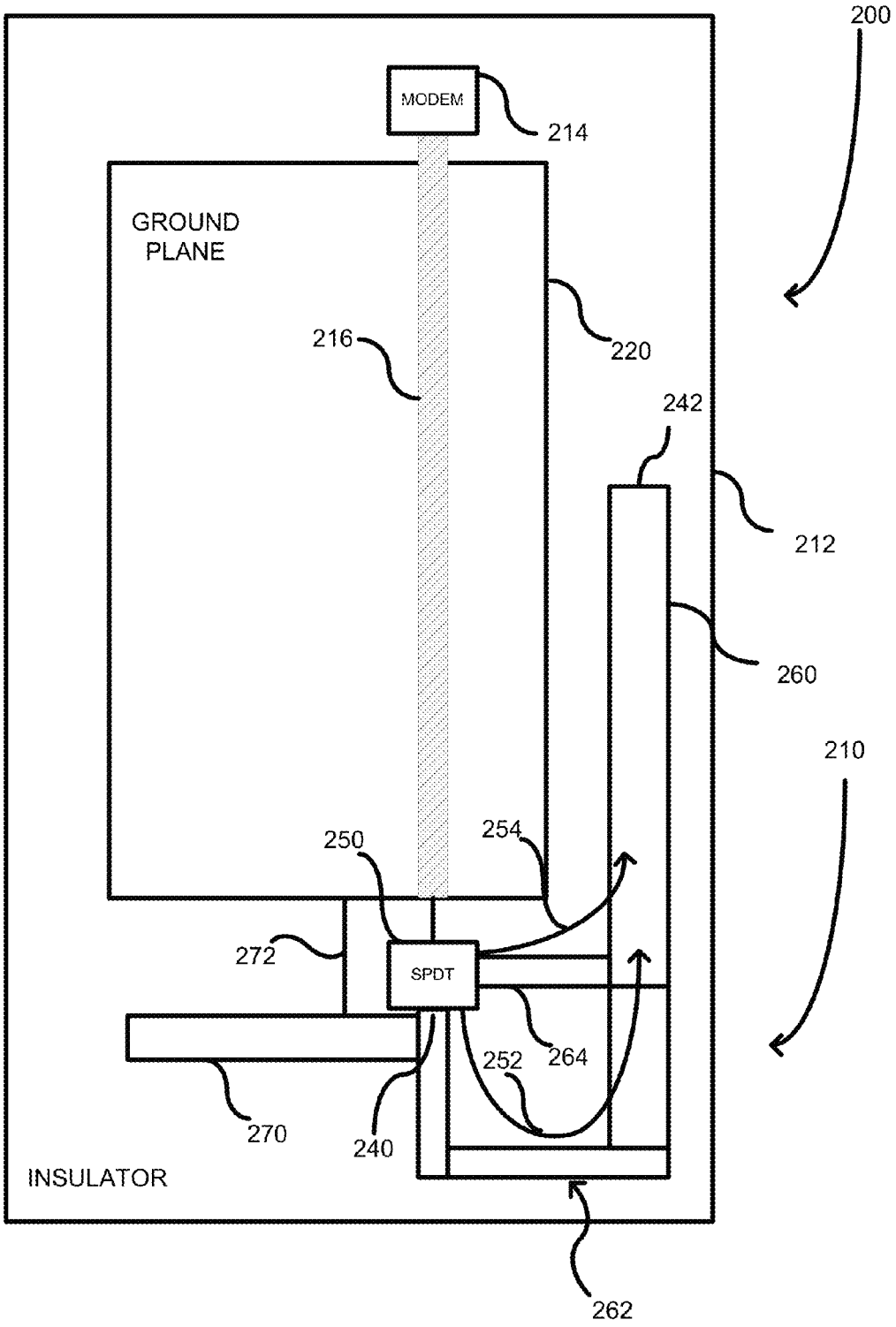
FIG. 2 is an example mobile device including details of an embodiment of the reconfigurable monopole antenna.

FIG. 2 shows a first embodiment showing an antenna configuration 200. The antenna configuration 200 includes an antenna 210 mounted on an insulating layer (e.g., plastic) 212. The antenna 210 can be a multiband quarter wave monopole antenna and can be formed from a thin layer of conducting material, such as printed or stamped metallic material. A modem 214 can communicate with the antenna 210 through a signal conductor 216, such as a trace on a printed circuit board or a cable. The signal conductor 216 is electrically isolated from a ground plane 220 in a well-known manner and can run below, on top of, or around (i.e., not coextensive with) the ground plane. The antenna 210 can include a radiator element 260 having a first end 240 and a distal end 242. Adjacent the first end 240 is a feed-point switch 250, used to control a direction of current through the antenna 210. The switch 250 includes an input control line (not shown) that can be provided by the modem or other desired source. Thus, the modem can determine a desired frequency based on the state of the mobile device and dynamically control the antenna to change frequency bands. The switch 250 is located at or near (e.g., within $\lambda/10$) the feed point of the antenna 210. The feed point is well-known in the art as being a point where the antenna starts and is fed an input signal from the conductor 216 (any type of transmission line originating on the RF front end). One example feed point is where a trace ends on a PCB and connection to the antenna is made using a via point, C-clips or pogo pins. Another example is where a cable conductor is soldered to the antenna. As shown, the current can take a long path 252 or a short path 254 through the antenna according to the feed-point switch 250. In either event, the current passes through an elongated, shared portion of the radiator 260. To establish the different current paths, the antenna 210 includes a U-shaped bend, shown generally at 262 and indicated by the curvature of line 252, and a bypass conductor 264. The bypass conductor 264 creates the current path 254 that bypasses the U-shaped bend making the overall current path shorter. The antenna 210 can further include a parasitic radiator 270 coupled to the ground plane 220 through conductor 272 and further coupled to the first end 240 of the antenna 210. The parasitic radiator 270 can provide for impedance matching at both low frequency states.

The feed-point switch 250 is shown as a single pole, double throw (SPDT) switch that is responsive to the control signal to switch the antenna between at least two modes of operation. In a first mode of operation, the longer current path 252 can be used to supply the shared portion of the radiator element 260. In this mode, the antenna 210 can allow operation at low frequencies. In a second mode of operation, the shorter current path 254 can be used to supply the radiator element 260. In this mode, the antenna can allow operation at higher frequencies. Thus, using one SPDT switch, two different groups of frequency bands can be used that are located in the lower frequency spectrum of LTE.

It should be recognized that the antenna configuration 200 can be extended to additional current paths by simply adding another current path having a desired length associated with a frequency band and modifying the switch to be able to handle switching between the different current paths. Thus, three, four, five, etc. current paths can be used.

Figure 3:
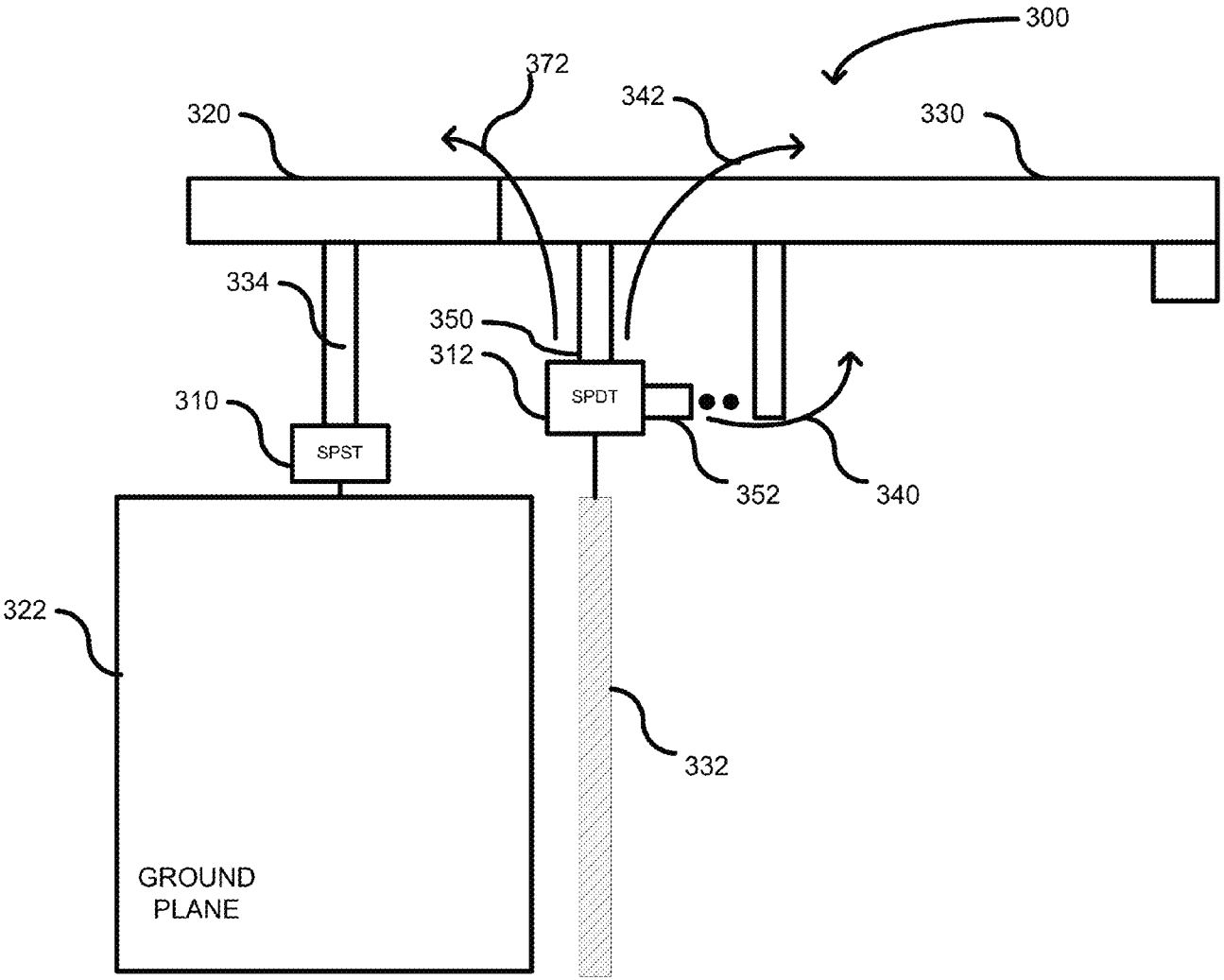
FIG. 3 is another embodiment of the reconfigurable monopole antenna.

FIG. 3 shows an alternative embodiment of an antenna configuration 300 including a multiband monopole antenna. In this embodiment, two switches 310, 312 are used. Control signals (not shown) can be supplied to the switches 310, 312 by a modem or other source. Switch 310 is a ground-plane switch and can be inserted between a parasitic radiator 320 and a ground plane 322. Switch 312 is a feed-point switch coupled between a radiator element 330 and a signal conductor 332 and positioned at or near the feed point. The switch 310 can be a single pole, single throw switch that connects conductor 334 of the parasitic radiator 320 to ground when actuated. Switch 312 can be a single pole, double throw switch similar to FIG. 2. In this embodiment, the conductor 332 is shown as not overlapping with the ground plane, but it can be implemented like FIG. 2. The switch 312 can control different current paths 340, 342 that have different lengths as dictated by the length of antenna arms 350, 352. Arm 352 is shown with dots to indicate that any desired meandering can be built in to ensure that arm 352 is longer than arm 350. Additionally, the antenna radiator element 330 has a majority of its length being shared by both current paths 340, 342.

In the FIG. 3 embodiment, with switch 310 turned on, the parasitic radiator 320 (the third arm of the antenna), can be connected to PCB ground plane 322 for impedance matching at both low frequency states. When the switch 310 is turned off, the parasitic radiator 320 can have an additional use to generate high frequency resonance. By simultaneously connecting the radiator element 330 while the parasitic radiator is producing a high-frequency response, the higher order resonance of the radiator section 330 couples to the one provided by the fundamental resonance of the parasitic radiator 320, widening the bandwidth at high frequencies to accomplish a greater overall frequency coverage.

Thus, using only two switches, at least three different antenna modes of operation can be selected. In a first mode of operation, path 340 is activated (using switch 312) with switch 310 turned on (grounding the parasitic radiator). In a second mode of operation, path 342 is activated with switch 310 turned on (grounding the parasitic radiator). In these first two modes, the parasitic radiator serves the purpose of impedance matching. In a third mode of operation, current path 372 is activated by turning switch 310 off and selecting current path 340 using switch 312. A possible fourth mode of operation can have current path 342 (the shorter path) selected with switch 310 off.

Figure 4:
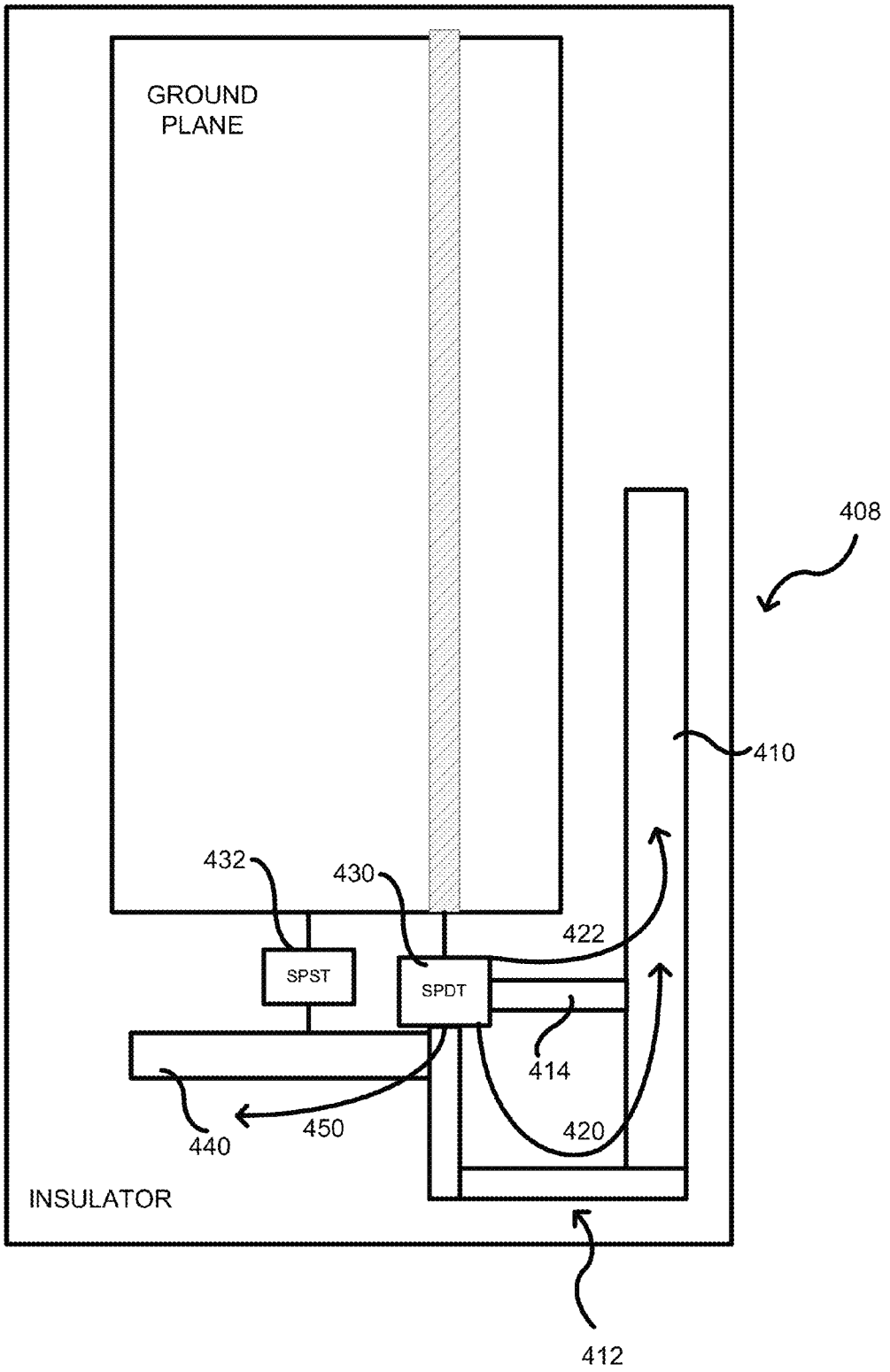
FIG. 4 is still another embodiment of the reconfigurable monopole antenna.

FIG. 4 shows an embodiment similar to the FIG. 3 two-switch design, but with an antenna structure similar to FIG. 2. The antenna 408 includes an elongated radiator element 410, a U-shaped bend 412 and a bypass conductor 414. Similar to the embodiment of FIG. 2, current paths 420, 422 are selectively controlled through use of a control signal (not shown) to switch a feed-point switch 430 between two different potential states. Ground-plane switch 432 can also be used to selectively couple or decouple ground to a parasitic radiator 440. With the switch 432 turned off, current can flow as indicated at 450 to work in conjunction with one of the other selected current flows 420, 422 for operation in a desired frequency band. Other non-labeled elements in FIG. 4 are similar to those of FIG. 2. In testing a configuration similar to that shown in FIG. 4 and using the three modes described above, in the first mode of operation, the multiband monopole antenna operated between approximately 700 MHz to 800 MHz, in the second mode of operation, the multiband monopole antenna operated between about 900 MHz and 1000 MHz, and in the third mode of operation, the multiband monopole antenna operated at greater than 1750 MHz.

Figure 5:
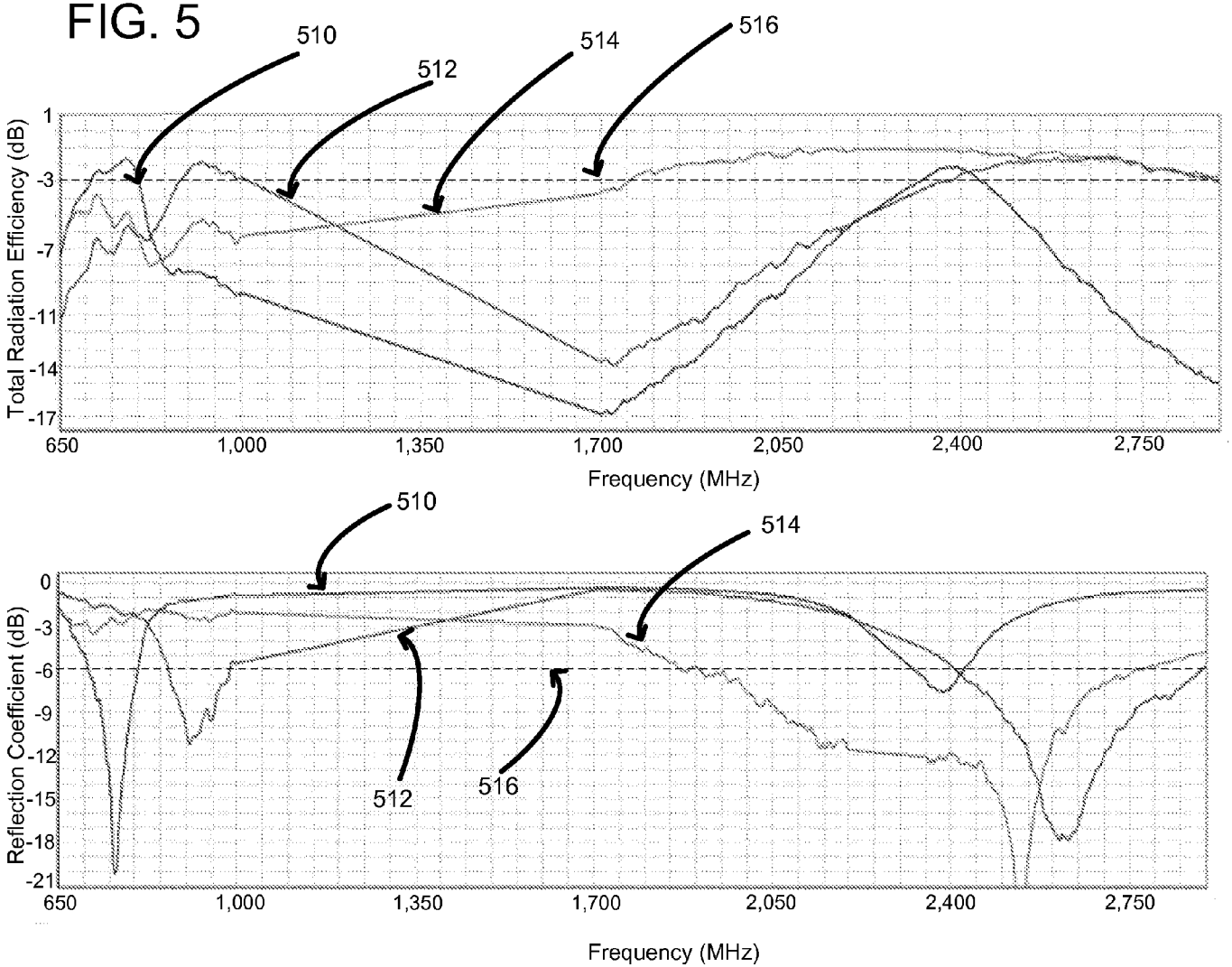
FIG. 5 are graphs showing an antenna efficiency versus frequency and a reflection coefficient of the antenna.

FIG. 5 shows an antenna efficiency (in dB) versus frequency (top graph) and a reflection coefficient of the antenna (in dB) (bottom graph), which is a measure of the power reflected by the antenna. The first mode of operation is shown by line 510, the second mode by line 512, and the third mode by line 514. A dashed line 516 represents a desired level with high efficiency values >−3 dB and low reflection coefficients <6 dB. As can readily be seen, the embodiments were successfully able to cover multiple frequency bands using a single antenna without having complex tradeoffs between different bands. Therefore, the antenna performance is optimized independently for each band. This technique can be extended to many other topologies. The number of switches or throws of each switch can be changed depending on the desired operation and frequency bands. A baseband integrated circuit can be responsible for choosing the switching states depending on the device operation through general purpose I/O lines.

Figure 6:
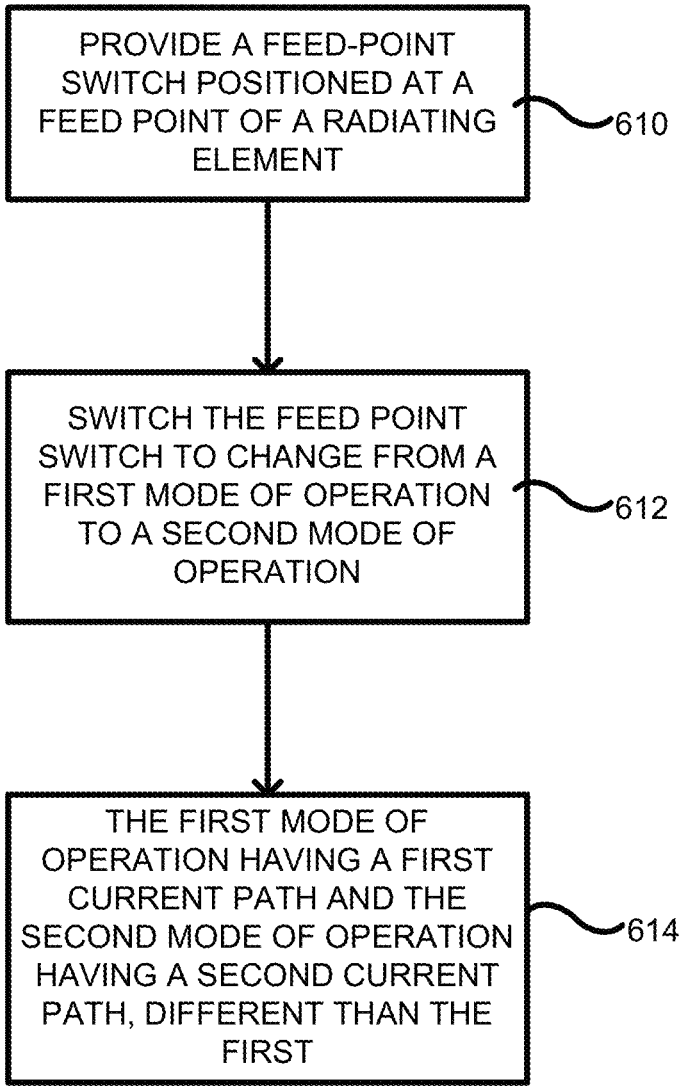
FIG. 6 is a flowchart of an embodiment that can be used reconfiguring the monopole antenna.

FIG. 6 is an embodiment of a method for operating a multiband monopole antenna. In process block 610, a feed-point switch is provided at a feed point of a radiator element. By being provided at the feed point it is meant that the switch is within $\lambda/10$ of the feed point. In process block 612, the feed-point switch can be switched to change from a first mode of operation to a second mode of operation. In process block 614, the first mode of operation can have a first current path and the second mode of operation can have a second current path, different than the first current path. Both current paths can use substantially the same elongated portion of a radiator.

Any of the disclosed methods can have aspects that are implemented as computer-executable instructions stored on one or more computer-readable storage media (e.g., one or more optical media discs, volatile memory components (such as DRAM or SRAM), or nonvolatile memory components (such as flash memory or hard drives)) and executed on a computer (e.g., any commercially available computer, including smart phones or other mobile devices that include computing hardware). As should be readily understood, the term computer-readable storage media does not include communication connections, such as modulated data signals. Any of the computer-executable instructions for implementing the disclosed techniques as well as any data created and used during implementation of the disclosed embodiments can be stored on one or more computer-readable media. The computer-executable instructions can be part of, for example, a dedicated software application or a software application that is accessed or downloaded via a web browser or other software application (such as a remote computing application). Such software can be executed, for example, on a single local computer (e.g., any suitable commercially available computer) or in a network environment (e.g., via the Internet, a wide-area network, a local-area network, a client-server network (such as a cloud computing network), or other such network) using one or more network computers.

It should also be well understood that any functionality described herein can be performed, at least in part, by one or more hardware logic components, instead of software. For example, and without limitation, illustrative types of hardware logic components that can be used include Field-programmable Gate Arrays (FPGAs), Program-specific Integrated Circuits (ASICs), Program-specific Standard Products (ASSPs), System-on-a-chip systems (SOCs), Complex Programmable Logic Devices (CPLDs), etc.

Furthermore, any of the software-based embodiments (comprising, for example, computer-executable instructions for causing a computer to perform any of the disclosed methods) can be uploaded, downloaded, or remotely accessed through a suitable communication means. Such suitable communication means include, for example, the Internet, the World Wide Web, an intranet, software applications, cable (including fiber optic cable), magnetic communications, electromagnetic communications (including RF, microwave, and infrared communications), electronic communications, or other such communication means.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope of these claims.

We claim:

1. A multiband monopole antenna, comprising:

a radiator element coupled to a feed point through at least two different current paths, the first current path being longer than the second current path to accommodate different frequency bands;

a ground plane;

a parasitic radiator coupled to the radiator element;

a ground-plane switch coupled between a ground plane and the parasitic radiator for selectably disconnecting the ground plane from the parasitic radiator; and a feed-point switch positioned at the feed point coupled between the radiator element and the feed point for selectively supplying current along the first current path or the second current path;

wherein a majority of the radiator element is shared by the first and second current paths.

2. The multiband monopole antenna of claim 1, wherein the multiband monopole antenna is a quarter wave monopole antenna.

3. The multiband monopole antenna of claim 1, further including at least a first control signal received by the feed-point switch and a second control signal coupled to the ground-plane switch for switching the multiband antenna between three different modes of operation.

4. The multiband monopole antenna of claim 3, wherein in a first mode of operation, the multiband monopole antenna operates between approximately 700 MHz to 800 MHz, in a second mode of operation, the multiband monopole antenna operates between 900 MHz and 1000 MHz, and in a third mode of operation, the multiband monopole antenna operates at greater than 1750 MHz and all of these modes of operation use the same radiator element.

5. The multiband monopole antenna of claim 1, wherein radiator element is formed from a thin layer of conducting material mounted on a non-conducting layer of plastic.

6. The multiband monopole antenna of claim 1, wherein positioned at the feed point means that the feed-point switch is within a distance of $\lambda/10$ of the feed point.

7. A method of operating a multiband monopole antenna, comprising:

providing a feed point switch positioned at a feed point of a radiator element of the multiband monopole antenna;

switching the feed point switch to change the multiband monopole antenna from a first mode of operation wherein a first current path of the radiator element is used to a second mode of operation wherein a second current path of the radiator element is used, wherein both the first and second current paths share a majority of the radiator element;

providing a parasitic radiator coupled to the radiator element near the feed-point switch;

providing a ground-plane switch coupled between the parasitic radiator and a ground plane, wherein in the first mode of operation the ground plane switch couples the parasitic radiator to the ground plane; and switching to a third mode of operation wherein the ground plane switch decouples the ground plane from the parasitic radiator.

8. The method of claim 7, wherein the multiband monopole antenna is a quarter wave monopole antenna.

9. The method of claim 7, wherein in the first mode of operation, the multiband monopole antenna operates between approximately 700 MHz to 800 MHz, in the second mode of operation, the multiband monopole antenna operates between 900 MHz and 1000 MHz, and in the third mode of operation, the multiband monopole antenna operates at greater than 1750 MHz.

10. The method of claim 7, wherein positioned at the feed point means that the feed-point switch is within a distance of $\lambda/10$ of the feed point.

11. The method of claim 7, further including determining, in a modem, a desired frequency band and controlling the feed point switch to switch between modes.

12. The method of claim 11, wherein the feed point switch is controlled through user input.

13. A multiband monopole antenna, comprising:

a radiator element having a first end and an opposite distal end, the radiator element including an elongated portion coupled to the distal end and a U-shaped bend near the first end;

a single pole, double throw switch coupled to the first end of the radiator element; and a bypass conductor coupled between the single pole, double throw switch and the elongated portion of the radiator element so as to create a current path between the single pole, double throw switch and the radiator element that bypasses the U-shaped bend;

a parasitic radiator coupled to the first end of the radiator element; and a single pole, single throw switch coupled between the parasitic radiator and a ground plane, wherein the single pole, single throw switch selectably disconnects the ground plane from the parasitic radiator;

wherein the single pole, double throw switch either couples a feed point to the first end of the radiator or couples the bypass conductor to the feed point.

14. The multiband monopole antenna of claim 13, wherein the configuration of the single pole, single throw switch and the single pole, double throw switch allows the multiband monopole antenna to operate in three different modes of operation with three different frequency ranges.

15. The multiband monopole antenna of claim 14, wherein in a first mode of operation, the multiband monopole antenna operates between approximately 700 MHz to 800 MHz, in a second mode of operation, the multiband monopole antenna operates between 900 MHz and 1000 MHz, and in a third mode of operation, the multiband monopole antenna operates at greater than 1750 MHz.

* * * * *